US006401582B1

(12) United States Patent
Noé et al.

(10) Patent No.: US 6,401,582 B1
(45) Date of Patent: Jun. 11, 2002

(54) APPARATUS FOR REMOVING BINDER STRAPS FROM, FOR EXAMPLE, COILS BOUND THEREBY

(75) Inventors: Rolf Noé, Mühlheim/Ruhr; Andreas Noé; Reinhold Keller, both of Kerken, all of (DE)

(73) Assignee: BWG Bergwerk- und Walzwerk-Maschinenbau GmbH, Duisburg (DE)

( * ) Notice: Subject to any disclaimer, the term of this patent is extended or adjusted under 35 U.S.C. 154(b) by 0 days.

(21) Appl. No.: 09/468,599

(22) Filed: Dec. 21, 1999

(30) Foreign Application Priority Data

Jan. 20, 1999 (DE) ..... 199 02 026

(51) Int. Cl.[7] ..... B26D 7/14; B69B 69/00

(52) U.S. Cl. ..... 83/176; 83/368; 83/454; 83/465; 83/562; 83/924

(58) Field of Search ..... 83/176, 924, 949, 83/950, 909, 78, 368, 454, 456, 465, 557, 562, 563; 242/562, 523.1, 527, 527.6, 527.7

(56) References Cited

U.S. PATENT DOCUMENTS

| | | | | | |
|---|---|---|---|---|---|
| 1,914,528 | A | * | 6/1933 | Reid | 83/176 |
| 2,059,873 | A | * | 11/1936 | Jones et al. | 242/527.6 |
| 2,539,745 | A | * | 1/1951 | Keller | 242/523.1 |
| 3,304,020 | A | * | 2/1967 | Fleenor | 242/527.6 X |
| 4,219,914 | A | * | 9/1980 | Bartzick et al. | 83/909 X |
| 4,399,729 | A | * | 8/1983 | Malinowski et al. | 242/562 X |
| 4,437,223 | A | * | 3/1984 | Petros | 83/909 X |
| 4,527,750 | A | * | 7/1985 | Juntti | 242/525.2 |
| 4,572,450 | A | * | 2/1986 | Lindquist | 242/527 X |
| 4,779,498 | A | * | 10/1988 | Perkins | 83/924 X |
| 4,976,583 | A | * | 12/1990 | Moltrasio | 83/909 X |
| 5,179,878 | A | * | 1/1993 | Kranefeld et al. | 83/909 X |
| 5,467,676 | A | * | 11/1995 | Hooper et al. | 83/176 X |
| 5,988,030 | A | * | 11/1999 | Hada et al. | 83/176 |

FOREIGN PATENT DOCUMENTS

| | | |
|---|---|---|
| DE | 41 19 336 | 2/1992 |
| DE | 196 07 541 | 7/1997 |
| EP | 0 592 845 | 9/1993 |

* cited by examiner

*Primary Examiner*—Rinaldi I. Rada
*Assistant Examiner*—Charles Goodman
(74) *Attorney, Agent, or Firm*—Herbert Dubno

(57) ABSTRACT

An apparatus for removing binder straps from coils of metal strip in which a cage is engageable with the coil and has a blade carriage displaceable over at least a region in which binder straps may be provided in a continuous manner so that a wedge can engage beneath the straps in succession and a cutting tool can cut through straps in a single continuous operation without interrupting the movement of the carriage. The wedge and the carriage can be provided with clamping elements to engage the strap after it is cut to allow it to be transported to a scrap bin.

11 Claims, 8 Drawing Sheets

APPARATUS FOR REMOVING BINDER STRAPS FROM, FOR EXAMPLE, COILS BOUND THEREBY

FIELD OF THE INVENTION

Our present invention relates to an apparatus for removing binder straps from articles which are provided with them, especially coils of metal strip. The coils of metal strip can be cold rolled strip as well as hot-rolled strip and the binding of the coil can be in the hot or cold state as well.

BACKGROUND OF THE INVENTION

Coils can be bound with two or more binder straps each encircling the coil and spaced apart from one another over a region of the width of the coil. There are devices for removing such binder or tie straps and in general an apparatus for this purpose can comprise a blade cage in which a blade carriage is integrated and the blade cage can be displaced between working positions. The indication of an end position is usually effected with an inductive proximity switch.

The blade carriage can be equipped with a lifting wedge and a separating tool which can cut through the strap when the latter is lifted away form the coil. The lifting wedge is thus displaced along the coil surface and lifts the binder strap therefrom. The tool travels along behind the lifting wedge and severs the strap.

To allow the device to detect the binder strap, the conventional binder strap remover is also equipped with a sensor or detector which, on travel of the blade carriage over the coil surface, can detect the binder strap.

This system has the drawback that the sensor or detector is expensive and frequently unreliable. Since each binder strap is detected individually, the operations of lifting the binder strap and severing it are also carried out individually for each binder strap. Where multiple binder straps are provided on one coil, the device usually comes to a standstill between the binder strap removal operations. The operations is thus time-consuming and labor intensive. It is also prone to failure.

OBJECTS OF THE INVENTION

It is the principal object of the present invention to provide an apparatus or device for the removal of binder straps from articles encircled thereby, especially coils, whereby drawbacks of earlier systems are avoided.

A more specific object of this invention is to provide an apparatus for removing such a binder strap, especially from coils having a plurality of such straps, which eliminates the need for a binder strap sensor and hence the added cost of maintenance concerns for such a sensor and the element of unreliability which may be introduced thereby.

Still another object of the invention is to provide an apparatus for the purposes described which can eliminate the stepwise mode of operation hitherto required and provide a fully automatic removal of a plurality of binder straps, especially for articles like coils of metal strip.

SUMMARY OF THE INVENTION

These objects are attained, in accordance with the invention with a blade cage which can be brought into contact with an article provided with a plurality of binder straps, especially a coil of metal strip, having a blade cage with a drive for displacing the blade cage across the width of the coil and transversely to the binder strap thereon. This movement of the blade carriage is referred to as a stroke of the blade carriage. According to the invention, the blade carriage is formed with a lifting wedge for lifting the binder strap away from the periphery of the coil and a separating tool which operates in the region of the lifting wedge for cutting through the lifted binder strap.

The blade carriage is displaceable with a continuous stroke at least over a region of the coil width which is provided with the binder straps so that the binder straps are successively severed upon lifting by the wedge in a single continuous process, without stopping and without requiring a sensor for detecting those straps. More particularly, the apparatus according to the invention can comprise:

a blade cage engageable with each article;

a blade carriage displaceable on the cage along the width of each article and over the region from which binder straps are to be removed;

a lifting wedge on the blade carriage engageable beneath each binder strap in succession as the blade carriage is displaced along the width of the respective article;

a separating tool on the carriage cooperating with the lifting wedge for severing each binder strap lifted by the wedge; and means on the cage connected with the blade carriage for continuously advancing the blade carriage across the region to automatically lift and sever all of the binder straps on a respective article in succession.

Where one or more binder straps are provided over a region of the width of the coil, the blade carriage is displaced in an uninterrupted stroke from one side of the region to the other, engaging each binder strap in turn and without interruption of its movement, lifting the binder straps successively and as each one is lifted, cutting them through with the aforementioned tool. The continuous and automatic operation is carried out without a sensor for the binder straps fully automatically.

The cutting tool is automatically moved against the lifted binder strap and can be a continuously driven blade or a blade which is entrained in rotation by its engagement with the binder strap.

Preferably, the cutting tool is a roller blade and this roller blade can define with the lifting wedge a predetermined cutting angle and can be entrained as the binder strap enters into the convergence between the blade and the lifting wedge in the course of the continuous displacement of the blade carriage across the region of the coil provided with the binder straps.

While the roller blade can be a continuously driven blade, preference is given to a blade free from a drive which is set into rotation as it engages a respective strap. The system of the invention has the advantage that it is relatively simple and does not require a sensor for the binder strap or a control of the cutting tool as has been conventionally required. The device is thus largely maintenance free and the operation of the device can be effected at minimum cost.

According to a feature of the invention, the lifting wedge is a stepped wedge having a pair of inclined ramp surfaces lying on opposite sides of a lifting tongue which projects forwardly of the inclined ramp surfaces in the direction of movement of the blade carriage across the region of the coil provided with the binder straps. In the center of the wedge a slit can be provided and the roller blade which forms the cutting tool can extend into this slit.

The wedge tongue can be especially flat and thus reliably can be forced beneath the strap simply by being guided along the surface of the coil to lift the strap. The lifting operation is facilitated by providing the lifting wedge with a relatively flat leading portion which initially engages beneath the strap and is followed by a steeper portion which displaces the strap away form the periphery of the coil.

The roller blade can be journaled about an axis which is disposed above the lifting wedge and extend orthogonally to the direction of displacement of the lifting wedge. The roller blade can thus be automatically set into rotation by engagement with the strap.

The blade carriage and the lifting wedge in the blade carriage can advantageously be provided with a spring suspension and can be resiliently biased against the coil surface so that the lifting wedge rests resiliently thereagainst. This elastic suspension can enable compensation for surface irregularities in the region of the coil surface.

At its side opposite that from which the tongue extends, the wedge can have a glide riding on the coil surface and preferably which is rounded and which serves to press the tongue portion of the wedge against the surface of the coil so that it reliably passes beneath the tensioned binder strap.

To facilitate the movement of the binder carriage along the coil, the latter can have wheels or rollers which ride along the coil surface. In addition, the blade carriage can have a hydraulic, pneumatic or electromagnetic drive which imparts the stroke to the blade carriage. The drive can have a lifting and lowering component as well as a traversing component. The drive thus serves to press the wedge against the coil surface in the starting position, to traverse the wedge over the aforementioned region of the coil in the working position and to lift the wedge away from the coil surface upon its return to the starting position in an end position of the carriage following the traverse. The limiting positions of the carriage can be defined by an inductive proximity switch, which, however, does not serve to detect the binder straps themselves and hence is not prone to the drawbacks of sensors of the type previously described.

According to a feature of the invention, the lifting wedge is formed with a lower clamping beam against which the separate ends of the strap may be clamped by an upper clamping beam. The upper clamping beam can thus be swung downwardly toward the lower clamping beam to engage the strap ends thereagainst. The clamping action can be effected also hydraulically, pneumatically or electromechanically and the clamping action and its release can be controlled by or engaged by an inductive proximity switch. The blade cage with the severed but clamped straps can be displaced into a disposal position at which the straps are released.

The binder straps which are cut free from the coil and can be wound or rolled up and after windup into a spiral can be discharged into a scrap bin.

The lower clamping beam can preferably have a wedge-shaped support surface for the strap ends and the upper clamping beam can have a pair of rounded portions straddling the support surface and clamping the strap ends against the support surface on opposite sides thereof.

According to a further feature of the invention the blade cage is provided with support wheels or rollers along opposite longitudinal sides of the cage and preferably swingably mounted on the cage. These rollers allow the blade cage to be urged against the outer surface of the coil and allow the blade cage to hold the binder straps against the coil until the upper and lower clamping beams engage the respective strap ends. The binder straps are thus also held in position during the engagement of the binder straps by the wedge and the severing tool.

The support rollers or wheels can be journaled in pairs on cheek plates which are pivotally connected to the cage.

To prevent the blade cage from shifting on the coil during the lifting and severing of the binder straps, the blade cage can have a retaining device which is effective in the direction opposite that for effecting the stroke of the blade carriage and which can engage behind the end face of the coil. This retaining device can also be hydraulically, pneumatically or electromechanically actuated. Following the severing process for the particular coil, the cage is lifted away from the coil and shifted to deposit the removed straps in the scrap bin. The retaining device is released at that point.

According to still another feature of the invention the cage has a bridged length over the coil and defining the stroke of the wedge and severing tool which is greater than the maximum distance between the two outermost binder straps which may be used in binding the coils which are to be operated upon by the apparatus of the invention. This ensures that a single stroke of the blade carriage will remove and retain all of the straps which can possibly be used for the coils employed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
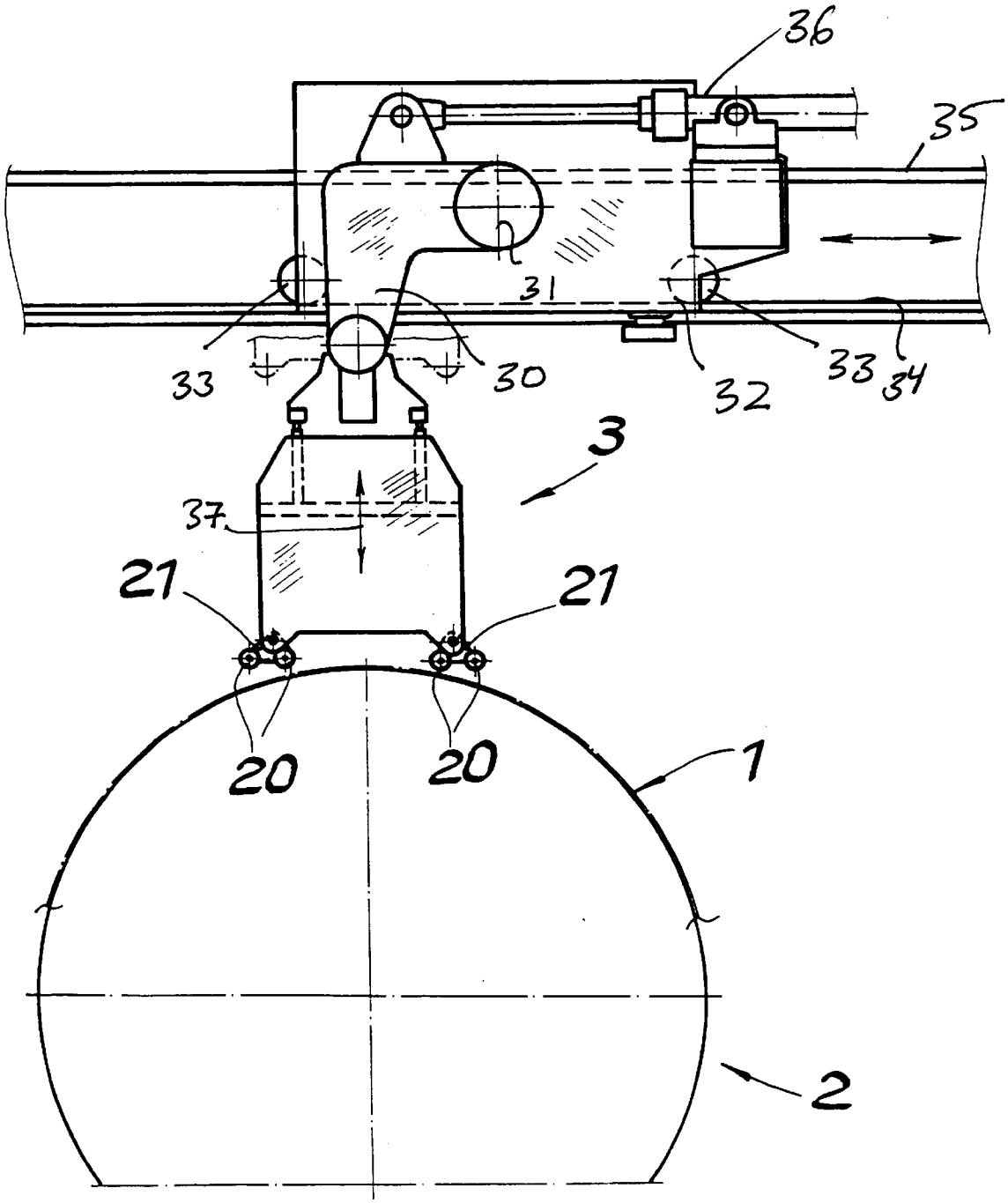
FIG. 1 is a diagrammatic end view showing a coil and the mechanism for positioning the blade cage or strap remover on the coil.

In the drawing we have shown an apparatus for the removal of binder straps 1 from coils 2 which are surrounded by those binder straps and where the binder straps hold the coils against unrolling. The coils are composed of metal strip and the binder strap remover has a blade cage 3 adapted to be pressed against the coil 2 for that purpose. As can be seen from FIG. 1, the cage 3 may be carried by a bell crank lever 30 pivotally connected at 31 to a bogey 32 displaceable on rollers 33 on a track 34 formed on a girder 35 above a row of coils 2 in a strip processing plant. On the bogey 32, a hydraulic, pneumatic or electromechanical actuator 36 is provided to pivot the bell crank lever 30 and raise or lower the cage 3 as represented by the double-headed arrow 37. In the lowered position, rollers 20 journaled on cheek plates 21 are pressed against the periphery of the coil 2. When displaced in the opposite direction, the cage 3 can be withdrawn from engagement with the coil and the clamp. Removed binder straps can be carried to a scrap bin or a coiler for the removed straps.

Figure 2:
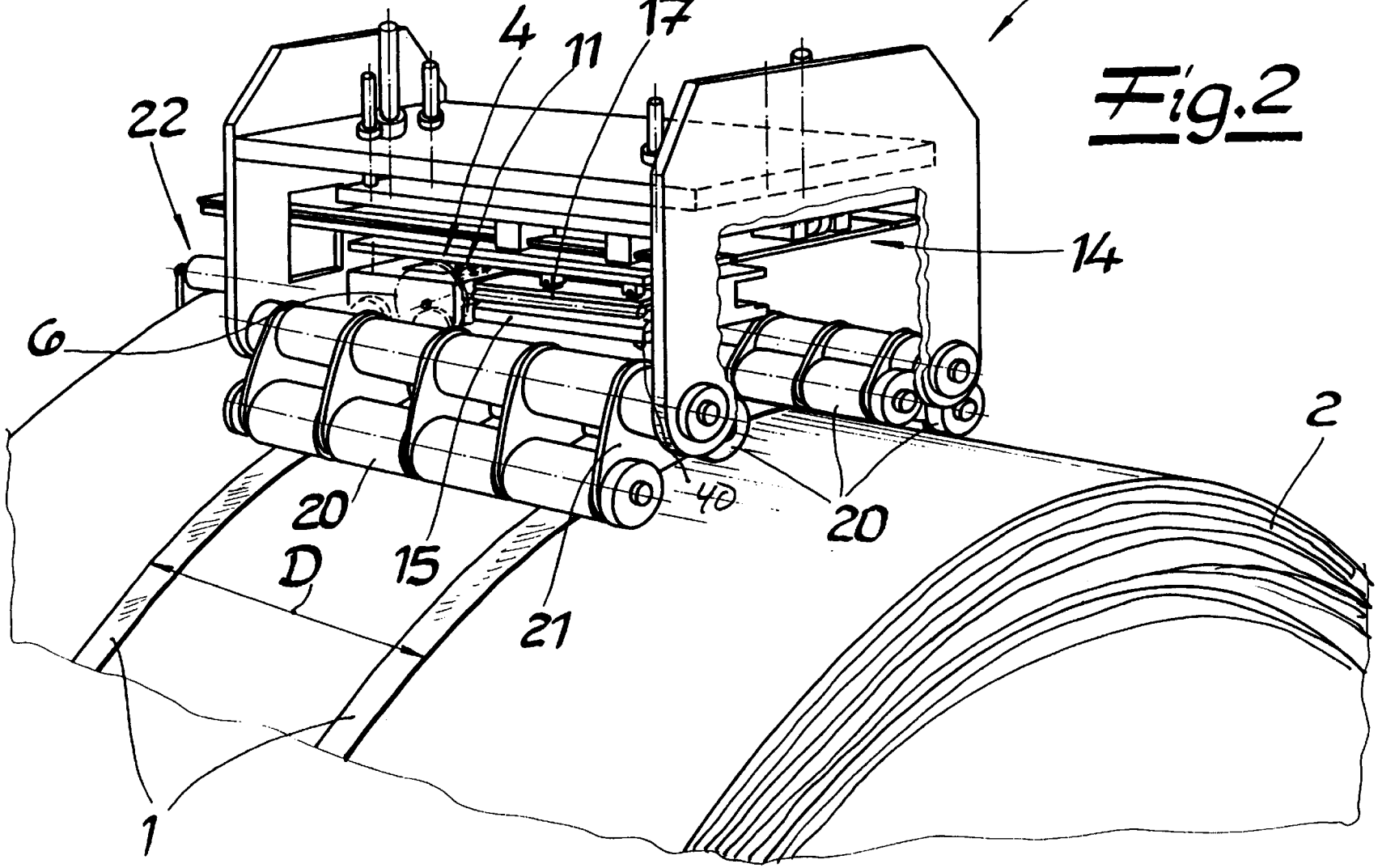
FIG. 2 is a perspective view, partly broken away showing the retaining device and the rollers supporting the cage against the coil, drawn to a larger scale than FIG. 1.
Figure 3:
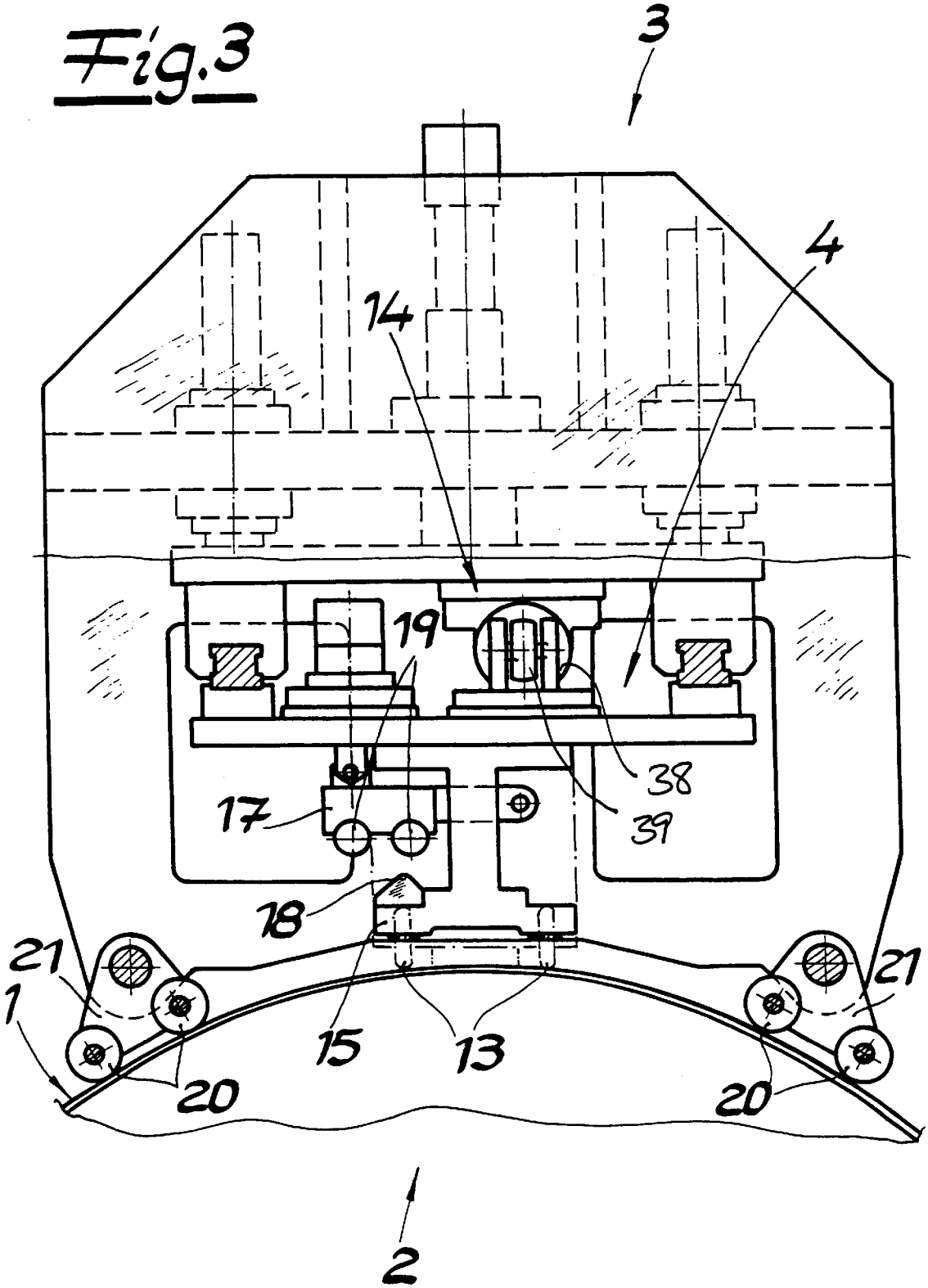
FIG. 3 is a detail view in the same direction as FIG. 1 showing the cage and a part of the mechanism within the cage.
Figure 4:
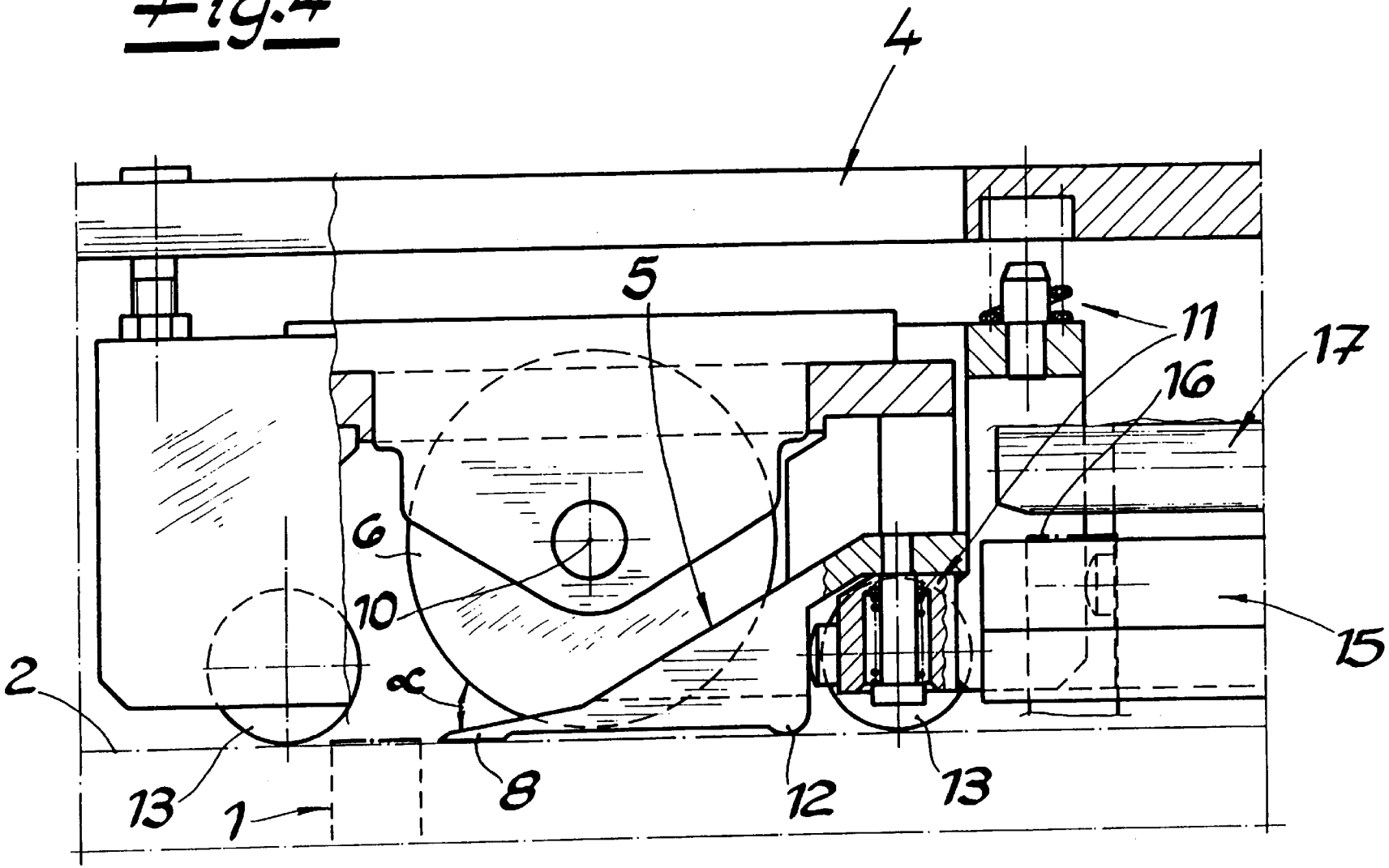
FIG. 4 is a side view, partly broken away of the blade carriage for the cage of FIG. 1.
Figure 5:
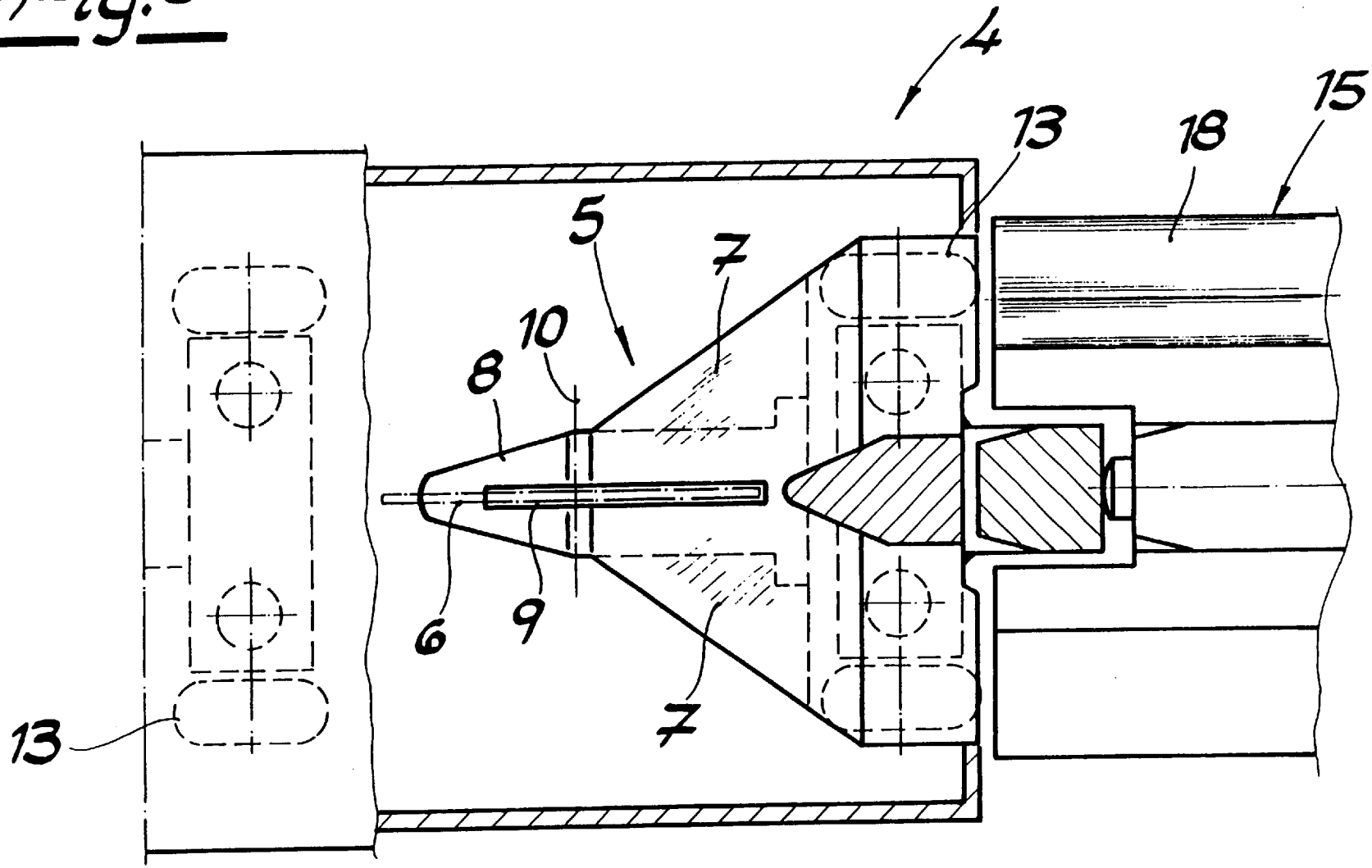
FIG. 5 is a plan view of the blade carriage of FIG. 4, partly broken away.

As can be seen from FIGS. 2–5, within the cage 3, a blade carriage 4 is displaceable by an actuator capable of moving this carriage transversely to the straps 1 over at least a region which has a width corresponding to the region in which the straps are provided. In FIG. 2 it can be seen that two such straps 1 are provided for the coil 2.

The carriage 4 is provided with a lifting wedge 5 engaging beneath the straps 1 and a cutting tool 6 for cutting through the lifted strap. The blade carriage 4 is displaceable in a continuous stroke at least over the distance D which represents the spacing of the outermost straps from one another. The means for displacing the carriage 4 is the hydraulic, pneumatic or electromechanical unit 14 which can be a cylinder 38 and a piston 39.

The tool 6 is a roller blade in the embodiment shown and defines with lifting wedge 5 a predetermined cutting angle a so that the strap is cut automatically by the movement of the wedge 6 and the tool past the strap in the course of a stroke of the carriage 4. The roller blade 6 is not driven in the embodiment shown but rather is entrained in rotation by its engagement with the binder strap 1.

The lifting wedge 5 is formed as a stepped wedge with a pair of wedge ramps 7 beyond which the tongue 8 extends. At the center of the wedge is a seal 9 receiving the roller blade 6. The blade 6 is rotatable about a horizontal axis 10 which is located above the lifting wedge 5 and runs orthogonally to the direction of displacement of the wedge 5. The blade carriage 4, the wedge 5 and the wheels 13 are resiliently supported by a spring suspension and are pressed resiliently against the coil surface.

Such a spring suspension is shown at 11 for the blade carriage 4.

In addition, the wedge is provided with glides 12 which are preferably rounded at its side opposite that from which the tongue 8 extends and which ride upon the periphery of the coil and serve to press the tongue against the coil surface. The blade carriage 4 has rollers 13 which ride on the coil surface although skids or slides may also be used to support the carriage thereupon.

The end positions of the carriage can be monitored by a proximity switch which has been indicated only diagrammatically at 40 in FIG. 2.

Figure 6:
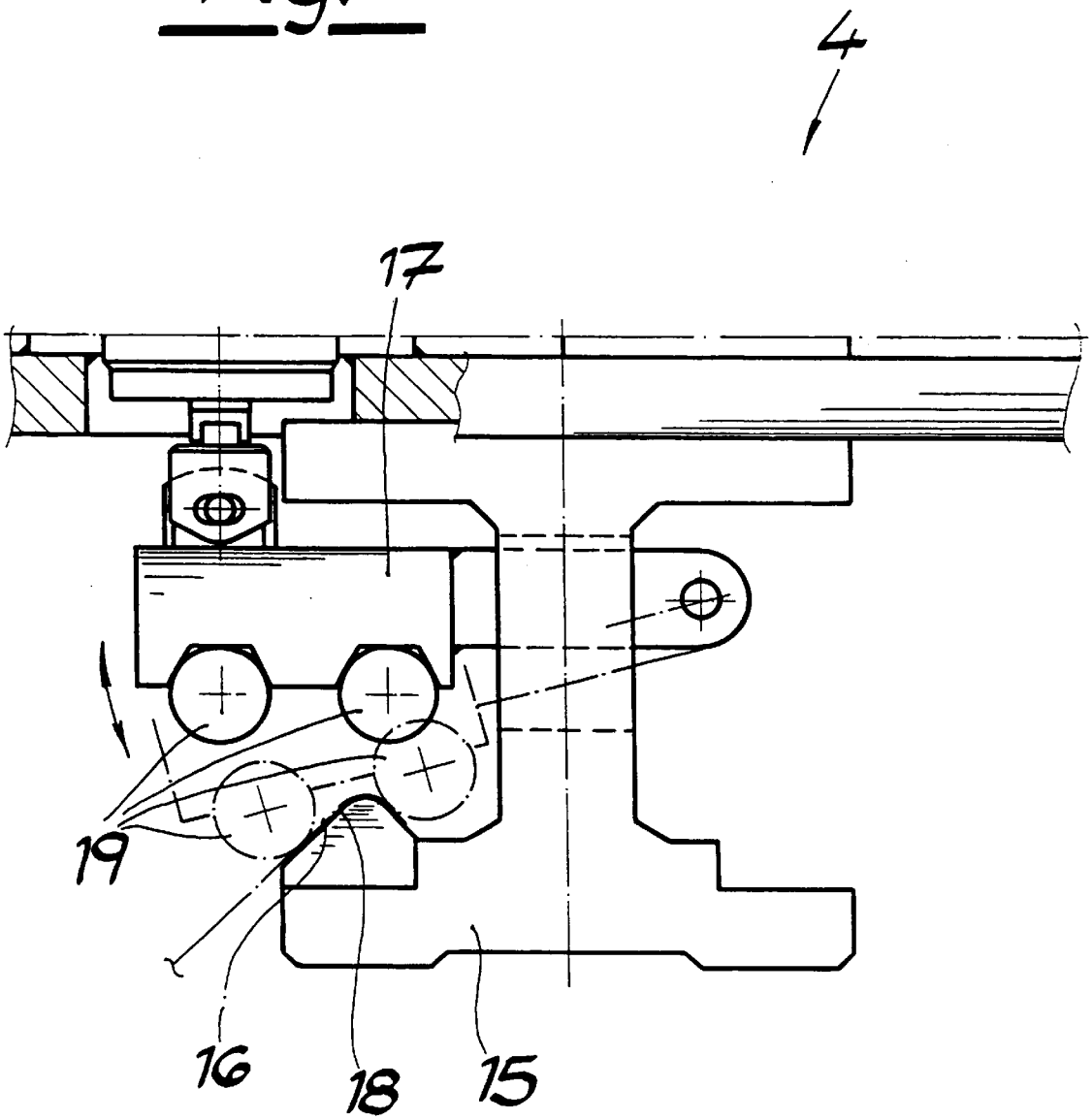
FIG. 6 is a detail showing the upper and lower clamping beams in a schematic front elevational view, partly broken away.
Figure 7:
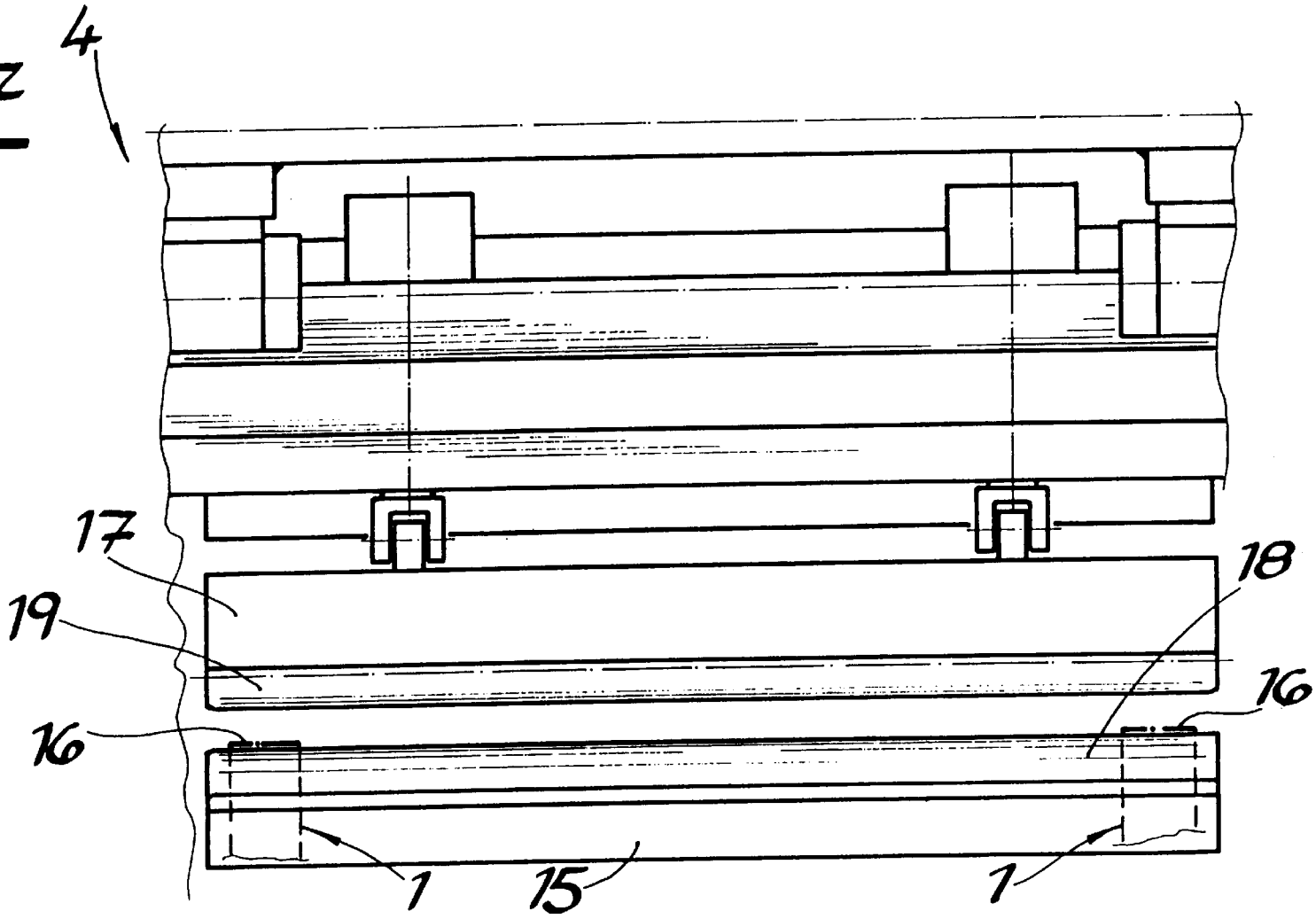
FIG. 7 is a side view of the clamping parts of FIG. 6 shown before clamping engagement.

The blade carriage 4 (FIGS. 6 and 7) has a lower clamping beam 15 on the wedge 5 and which engages below the strap ends 16 formed by cutting through the strap. The carriage 14 has an upper clamping beam 17 which forms a clamping device with the lower clamping beam capable of engaging these strap ends 16. The lower clamping beam has a wedge-shaped supporting surface 18 for the strap end 16 while the upper beam has round portions 19 straddling the support surface and engaging the strap ends on opposite sides thereof.

Figure 8:
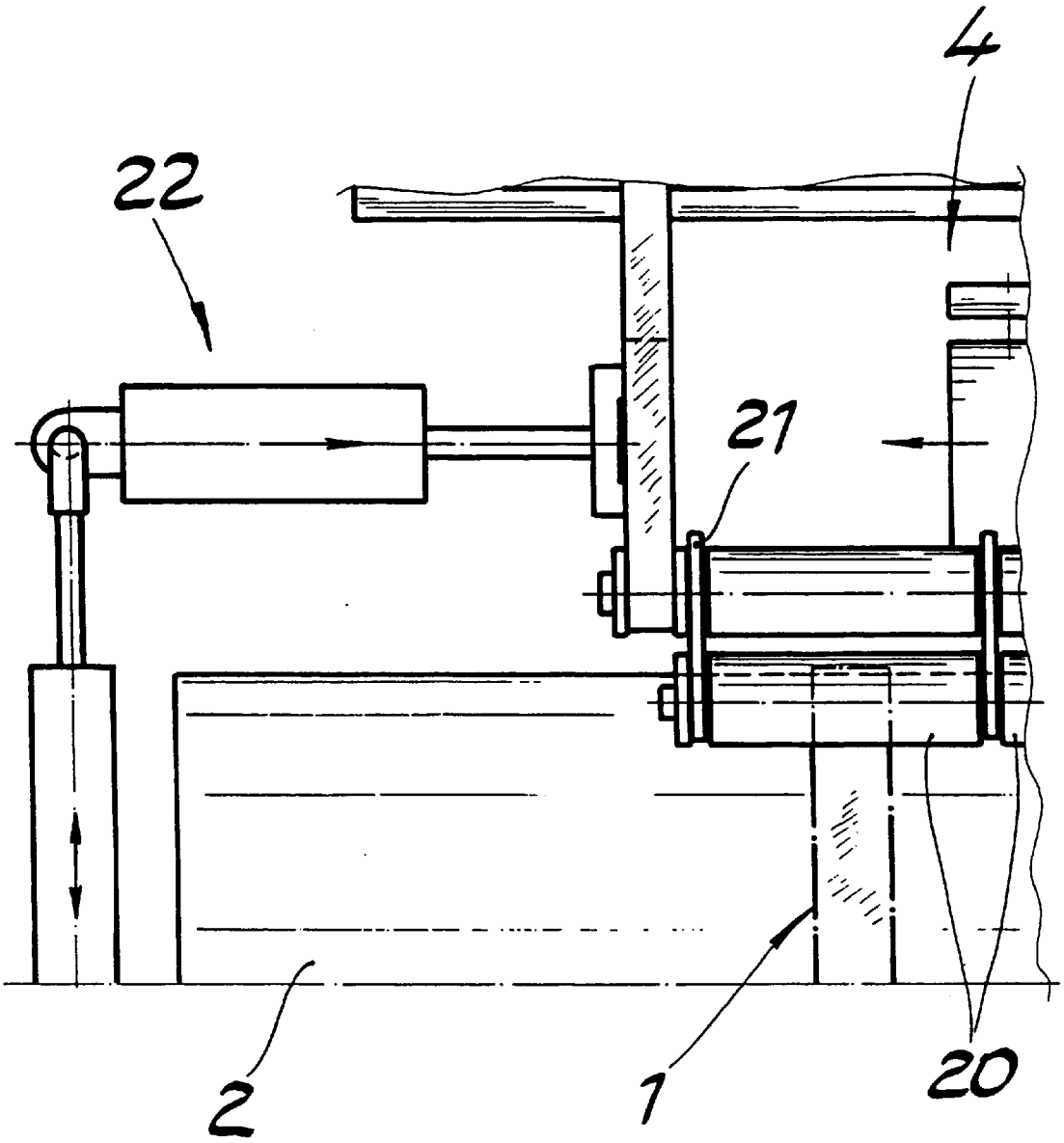
FIG. 8 is a schematic side view, drawn to a larger scale than FIG. 1, in the region of the retaining device.

As can be best seen from FIGS. 2 and 8, the blade cage 3 can have along its opposite longitudinal sides support rollers 20 which are journaled in cheek plates 21 pivotally mounted on the cage 3 in pairs. The cage 3 is provided with a retaining device (FIGS. 2 and 8), shown generally at 22, engaging behind the coil 2 and which is adjustable both in length and in height and which works opposite to the drive 14 to brace the cage 3 on the end of the coil when the carriage is shifted to engage and cut the coil. The cage bridges over the coil for a length sufficient to accommodate the stroke of the wedge 5 and blade 6 and which is greater than the maximum distance between the two straps 1 which are placed furthest apart.

We claim:

1. An apparatus for removing binder straps from articles in the form of coils each having a plurality of binder straps spaced apart over at least a region across a width of each coil, said apparatus comprising:

a blade cage engageable with each coil;

a blade carriage displaceable on said cage along the width of each coil and over said region from which binder straps are to be removed;

a lifting wedge on said blade carriage engageable beneath each binder strap in succession as said blade carriage is displaced along the width of the article;

a separating tool on said carriage cooperating with the lifting wedge for severing each binder strap lifted by said wedge;

means on said cage connected with said blade carriage for continuously advancing the blade carriage across said region to automatically lift and sever all of the binder straps of a coil in succession, said lifting wedge being a stepped wedge with a pair of spaced-apart inclined ramp surfaces including a leading shallow ramp surface and a trailing steeper ramp surface, a wedge tongue projecting forwardly of said ramp surfaces and a slit formed centrally in said stepped wedge between said ramp surfaces, said separating tool being a rotary blade extending into said slit, said separating tool being journaled on an axis above said lifting wedge, said axis running orthogonally to a direction of displacement of said lifting wedge, said cage being formed with members engaging outer turns of said coils; and a lower clamping bar engaging beneath an end of a severed strap upon movement of said carriage to engage said lifting wedge and said separating tool with said strap, and an upper clamping bar displaceable toward said lower clamping bar at least upon movement of said carriage into an end position and clamping said end between said bars.

2. The apparatus defined in claim 1 wherein said lower clamping bar has a wedge-shaped supporting surface with two sides for said end of said strap and said upper clamping bar has rounded portions engaging said end of said strap on said sides of said supporting surface.

3. The apparatus defined in claim 1 wherein said rotary blade defines a predetermined cutting angle $\alpha$ with said lifting wedge and automatically rotated to sever said binding strap upon passage of said binding strap between said lifting wedge and the rotary blade.

4. The apparatus defined in claim 1 wherein at least one of said carriage and said lifting wedge is provided with a spring suspension spring biasing said lifting wedge against the respective coil.

5. The apparatus defined in claim 1 wherein said wedge tongue projects at one side of said lifting wedge and said lifting wedge has a rounded glide continuously pressing against a surface of a respective coil on an opposite side.

6. The apparatus defined in claim 1, further comprising roller means of said carriage riding on a surface of a respective coil.

7. The apparatus defined in claim 1 wherein said means on said cage connected with said blade carriage for continuously advancing the blade carriage across said region is a hydraulic, pneumatic or electromechanical drive.

8. The apparatus defined in claim 1, further comprising a proximity switch for controlling an end position of said carriage in the travel thereof.

9. The apparatus defined in claim 1 wherein said cage has support rollers along opposite longitudinal sides of the cage and engageable with a surface of a coil, said support rollers being pivotally mounted on said cage.

10. The apparatus defined in claim 9 wherein said support rollers are rotatable on cheek plates pivotally mounted on said cage.

11. The apparatus defined in claim 1 wherein said means on said cage connected with said blade carriage for continuously advancing the blade carriage across said region has a stroke greater than a maximum distance D between the outermost straps of said region.

* * * * *